US008857525B2

(12) United States Patent
Noord

(10) Patent No.: US 8,857,525 B2
(45) Date of Patent: Oct. 14, 2014

(54) SEALING DEVICE AND METHOD FOR SEALING A CASING

(76) Inventor: Jan Noord, Ubbena (NL)

( * ) Notice: Subject to any disclaimer, the term of this patent is extended or adjusted under 35 U.S.C. 154(b) by 652 days.

(21) Appl. No.: 12/598,850

(22) PCT Filed: May 7, 2007

(86) PCT No.: PCT/NL2007/000119

§ 371 (c)(1),
(2), (4) Date: Apr. 20, 2010

(87) PCT Pub. No.: WO2008/136655

PCT Pub. Date: Nov. 13, 2008

(65) Prior Publication Data

US 2010/0206578 A1 Aug. 19, 2010

(51) Int. Cl.
*E21B 33/129* (2006.01)
*E21B 21/10* (2006.01)

(52) U.S. Cl.
CPC ..... *E21B 21/106* (2013.01)
USPC ..... 166/387; 166/217; 166/118

(58) Field of Classification Search
USPC ..... 166/373, 374, 375, 86.1, 90.1, 96.1, 166/88.2, 217, 387, 118
See application file for complete search history.

(56) References Cited

U.S. PATENT DOCUMENTS

| | | | | |
|---|---|---|---|---|
| 2,382,455 | A * | 8/1945 | Turechek | 166/217 |
| 2,589,506 | A * | 3/1952 | Morrisett | 166/123 |
| 2,603,294 | A * | 7/1952 | Barnes | 166/138 |
| 2,647,584 | A * | 8/1953 | Baker et al. | 166/217 |
| 2,870,794 | A * | 1/1959 | Thaxton | 138/90 |
| 3,181,614 | A * | 5/1965 | Brown | 166/122 |
| 3,229,767 | A * | 1/1966 | Carter | 166/134 |
| 3,285,343 | A * | 11/1966 | Urbanosky | 166/134 |
| 3,623,551 | A * | 11/1971 | Randermann, Jr. | 166/134 |
| 3,645,334 | A * | 2/1972 | McGill | 166/120 |
| 4,457,369 | A | 7/1984 | Henderson | |
| 4,997,042 | A * | 3/1991 | Jordan et al. | 166/379 |
| 5,014,782 | A * | 5/1991 | Daspit | 166/120 |
| 5,191,939 | A * | 3/1993 | Stokley | 166/379 |
| 5,293,905 | A * | 3/1994 | Friedrich | 138/89 |
| 5,586,601 | A * | 12/1996 | Pringle | 166/212 |
| 5,682,952 | A | 11/1997 | Stokley | |
| 5,735,348 | A | 4/1998 | Hawkins, III | |
| 6,394,180 | B1 * | 5/2002 | Berscheidt et al. | 166/193 |
| 6,899,183 | B2 * | 5/2005 | Dewey et al. | 166/387 |
| 7,124,779 | B2 * | 10/2006 | Syse | 138/89 |
| 7,694,730 | B2 * | 4/2010 | Angman | 166/77.51 |
| 8,171,960 | B2 * | 5/2012 | Syse et al. | 138/89 |
| 2002/0174992 | A1 * | 11/2002 | Dewey et al. | 166/382 |
| 2003/0226660 | A1 * | 12/2003 | Winslow et al. | 166/118 |
| 2003/0234120 | A1 | 12/2003 | Paluch et al. | |
| 2004/0000405 | A1 | 1/2004 | Fournier, Jr. et al. | |
| 2004/0168734 | A1 * | 9/2004 | Serret | 138/89 |
| 2007/0051521 | A1 * | 3/2007 | Fike et al. | 166/387 |

OTHER PUBLICATIONS

Dictionary definition of "withdraw", accessed Dec. 11, 2012 via thefreedictionary.com.*

* cited by examiner

*Primary Examiner* — Blake Michener
(74) *Attorney, Agent, or Firm* — The Webb Law Firm

(57) ABSTRACT

A sealing device which has a housing with an outside diameter, a core inside the housing; at least two sealing segments in slidable engagement with the core to change the outside diameter of the sealing device on at least one position of the sealing device; and at least two wedges in slidable engagement with the core and the sealing segments to seal the sealing device against a casing.

10 Claims, 6 Drawing Sheets

SEALING DEVICE AND METHOD FOR SEALING A CASING

BACKGROUND OF THE INVENTION

1) Field of the Invention

The present invention relates to a sealing device and method for sealing a casing. Such casings are for instance used in a wellbore for optionally sealing the casing to e.g. to circulate fluid through the casing.

2) Description of Related Art

U.S. Pat. No. 5,682,952 discloses an extendable casing circulator and method for sealing that may be utilised in either a conventional drilling rig, or in a top drive rig. The sealing device is brought into the casing using an extension device after which a packer element is inflated. This inflated packer element is deflated before withdrawal of the sealing device. In another embodiment the sealing device comprises a top cap that is put over the casing.

Casings that are used in e.g. oil industry show a variation in diameter and/or of their circular shape due to e.g. production tolerances. To bring a sealing device into a casing requires a relatively large gap between the outside diameter of the sealing device and the inside diameter of the casing in order to deal with the variations. Furthermore, there is a variation of nominal diameters between different casings that may increase the opening or gap if these have to be sealed with the same sealing device. This requires additional sealing measures, like an inflatable device, to seal such a gap. Due to the enormous pressure that may occur inside the casing, e.g. in a range of 200-1000 bar due to the e.g. gas pockets, these additional sealing measures may leak, damage etc. Furthermore, the forces acting on an extendable sealing device may become large, thereby requiring large dimensions of such a sealing device.

SUMMARY OF THE INVENTION

The present invention has for its objects to provide a sealing device for sealing a casing and (partly) obviate at least some of the above problems.

The present invention provides a sealing device for sealing a casing comprising:

a housing with an outside diameter;

a core inside the housing;

at least two sealing segments in slidable engagement with the core to change the outside diameter of the sealing device on at least one position of the sealing device; and at least two wedges in slidable engagement with the core and the sealing segments to seal the sealing device against the casing.

To seal the casing the sealing device is brought into the casing with the housing of such a sealing device having an outside diameter that, at the time of entering the sealing device into the casing, is smaller than the inside diameter of this casing. Inside the housing a core is located that is provided with sliding surfaces. At least two, but preferably four, sealing segments are in slidable engagement with this core and may slide over the sliding surfaces of the core. In case the sealing device is brought into the casing, and sealing of this casing is required, the sealing segments slide over the sliding surfaces of the core. This sliding will change the outside diameter of the sealing device on at least one position of this sealing device. This is achieved by providing the sliding surfaces such that, when sliding the sealing segments in longitudinal direction of the sealing device, the sealing segments are directed radially from the core. This is achieved by putting the sliding surfaces at an angle with the longitudinal direction of the sealing device, and the casing. Therefore, if the sealing segments slide further into the casing, they will be pushed outwards in a radial direction towards the sidewall of the casing. This results in the segments being transferred from the smaller outside diameter of the housing to the larger inside diameter of the casing. As the sealing segments are brought on a larger diameter for sealing, these segments do not fully engage the casing over the entire inside periphery. Therefore, at least two wedges, but preferably four wedges, are in slidable engagement with the core and sealing segments. These additional wedges compensate for the larger diameter of the inside casing. In other words, the lack of material of the segments, if brought on the larger diameter, is compensated for by the wedges. With such a sealing device a more mechanical sealing may be achieved by filling the gap between the housing of the sealing device and the inside diameter of the casing with the sealing segments and wedges.

A further advantage of the invention is that it is easier to bring a sealing device into a casing, thereby minimizing the time required to achieve the sealing of a casing. A further advantage of the invention is the obtaining of a larger flexibility for the range of nominal casing diameters that may be sealed with one specific sealing device. Furthermore, by reducing the number of parts and allowing a larger flexibility of diameters of the casings a more efficient operation may be achieved.

In a further embodiment according to the present invention the sealing device comprises first actuating means for moving the sealing segments and the wedges relative to the core, and second actuating means for moving the wedges relative to the core and the sealing segments.

In a first step of sealing a casing, when the sealing device is brought into the casing, first actuating means move the sealing segments and the wedges relative to the core over the sliding surfaces to increase the outside diameter of the sealing device inside the casing. In a second step the lack of material on the outside diameter of the sealing devices is compensated by moving the wedges relative to the sealing segments, thereby adding material on the outside diameter of the sealing device inside the casing. This will result in a more or less mechanical sealing of the casing by the sealing device.

In a further embodiment according to the present invention the sealing segments, wedges and core comprise a sealing strip.

By providing a sealing strip on the outside of the sealing segments and the wedges the sealing device will seal over the entire inside perimeter of the casing, also in presence of all kinds of variations and tolerances. In a preferred embodiment the sealing strip is made of a poly-urethane material that is preferably located into recesses provided in the sealing segments and the wedges. E.g. for a casing with a diameter of about 200 mm a sealing strip may extend about 1 mm outside the sealing segments and wedges. As the sealing segments move relative to the core, the core may be provided with a notch over its outside diameter. This notch may be filled with a sealing ring. Using these relatively small sealing strips a further improved sealing may be achieved by the sealing device according to the invention. A further advantage of these sealing strips is that the sealing device may cope with an even larger range of casing diameters, variances and tolerances.

In a further embodiment according to the present invention the core of the sealing device comprises a supply channel.

The supply channel is used to provide a wellbore with a fluid. This will be relevant when running casing into a hole, as the casing is normally filled with fluid as new joints are added to the casing string to prevent the collapse of the casing during the run-in operation. Also, the fluid may be required to remove sand etc. from the casing. By combining the sealing device with the supply channel a more efficient operation may be achieved, also in case of a casing being stuck in the hole. This combination prevents the use of separate equipment to free a stuck casing. A further advantage of such a combination is that by supplying the liquid, and at the same time sealing the casing, an increased pressure may be realised inside the casing. In a preferred embodiment the sealing device comprises a valve for closing the supply channel. The provision of this, e.g. non-return, valve prevents fluids flowing from the casing into the supply channel. In a further preferred embodiment the valve comprises guiding means to guide the sealing device into the casing. By designing the shape of the relevant parts of the valve this valve may act as guiding means thereby speeding up the sealing operation. In an even further preferred embodiment of the invention the valve of the sealing device comprises spring means. By adding spring means to the valve it is possible to incorporate a safety measure into the sealing device. This safety measure is actuated e.g. in case the pressure inside the supply channel increases. Thus, such a pressure increase will be limited, thereby preventing damage to the sealing device. Preferably, the supply channel is provided with an (threaded) insert on the exit of the supply channel that may be easily replaced. By designing this insert as the weakest part of the sealing device most of the damage will be accumulated in this insert. This will prevent damage to the other parts of the sealing device. As the insert is relatively easily removed and changed with an other insert damage and maintains costs will be reduced.

In a further preferred embodiment according to the present invention the sealing device comprises friction means to hold the sealing devices relative to the casing.

To prevent undesired removal of the sealing device from the casing due to e.g. an enormous pressure occurring inside the casing of e.g. 1000 bar, additional friction means in the form of claws and/or teeth will be provided. As soon as the sealing device is moving or intends to move in an undesired direction these claws or teeth will engage the sidewall of the casing, preferably on the inside, thereby increasing the friction forces acting against movement or even removal of the sealing device. Preferably, the friction means only act on the surface of the casing if the sealing device actually seals the casing.

The invention further relates to a method for sealing a casing.

With this method the same effects and advantages as described before for the sealing device will be obtained.

BRIEF DESCRIPTION OF THE DRAWINGS

The invention is further illustrated in the following description with reference to the annexed figures, which show.

DETAILED DESCRIPTION OF THE PREFERRED EMBODIMENTS

Figure 1:
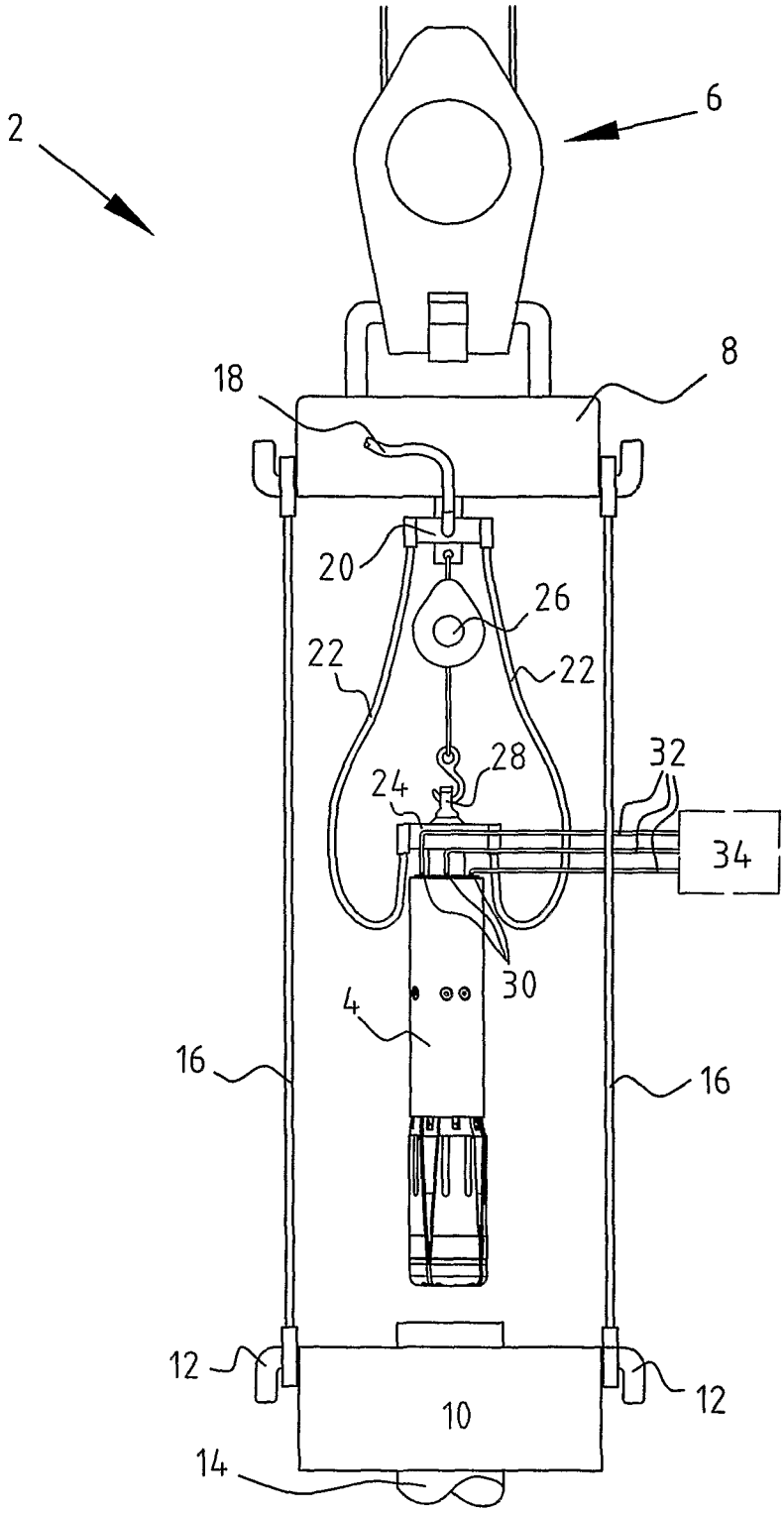
FIG. 1 a simplified view of a part of a drilling rig with a casing and a sealing device in accordance with the present invention.

A conventional drilling rig 2 (FIG. 1) comprises the sealing device 4. The rig 2 comprises a lifting device or travelling block 6 capable of transferring the top drive 8. Also, there is provided an elevator 10 provided with hooks 12. The elevator 10 supports in a conventional manner casing 14. The elevator 10 is connected to lifting device 6 by links 16. The sealing device 4 is connected with a liquid or mud supply 18 by connecting part 20 and hoses 22. Preferably, two hoses 22 are provided to have a stable orientation of the sealing device 4. Also, hoses 22 are provided with a sufficient length between connecting part 20 and entry part 24 to allow for a vertical displacement of the sealing device by hoist device 26. Hoist device 26 is connected to the sealing device 4 by connection 28. The sealing device 4 is provided with connections 30 for oil. Oil is supplied by hoses 32 from an oil supply and controller 34. These hoses 32 are also provided with a length sufficient for vertically displacing sealing device 4.

Figure 2:
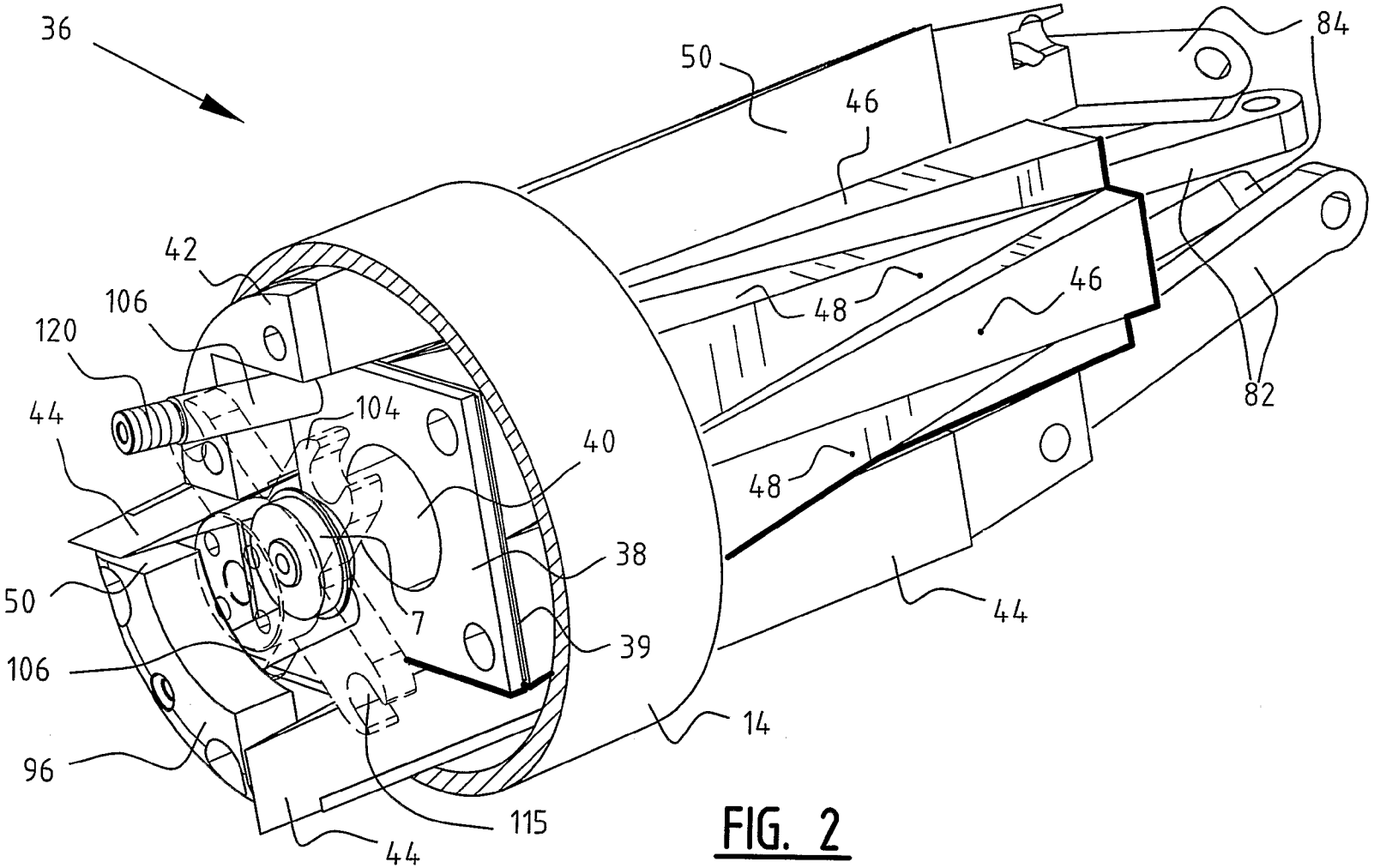
FIG. 2 the core, sealing segments and wedges of the sealing device from FIG. 1.
Figure 3A:
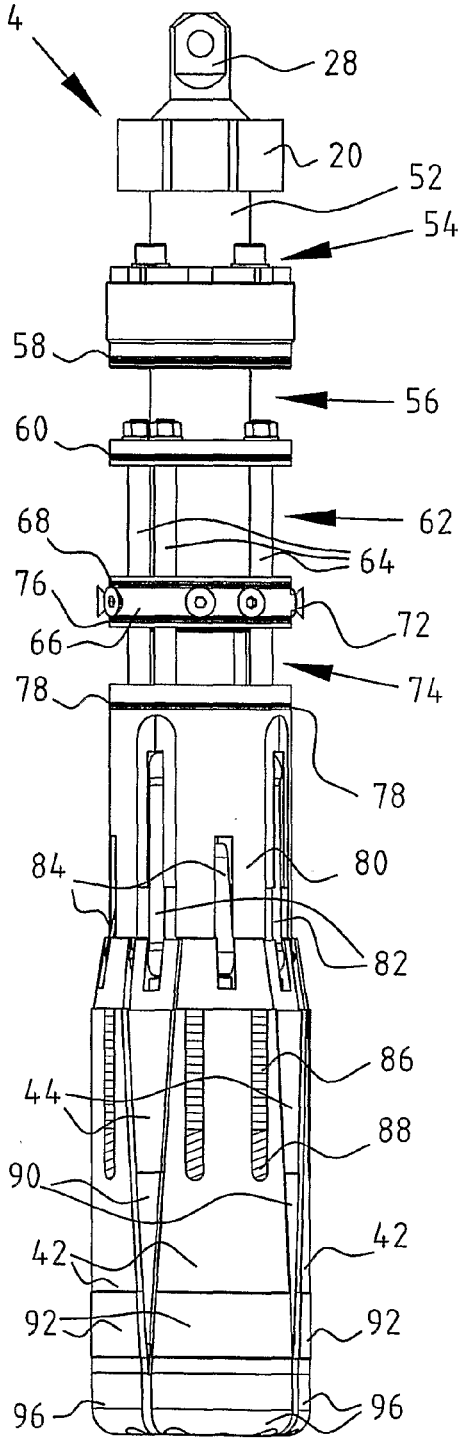
FIG. 3A the sealing device of FIG. 1.
Figure 3B:
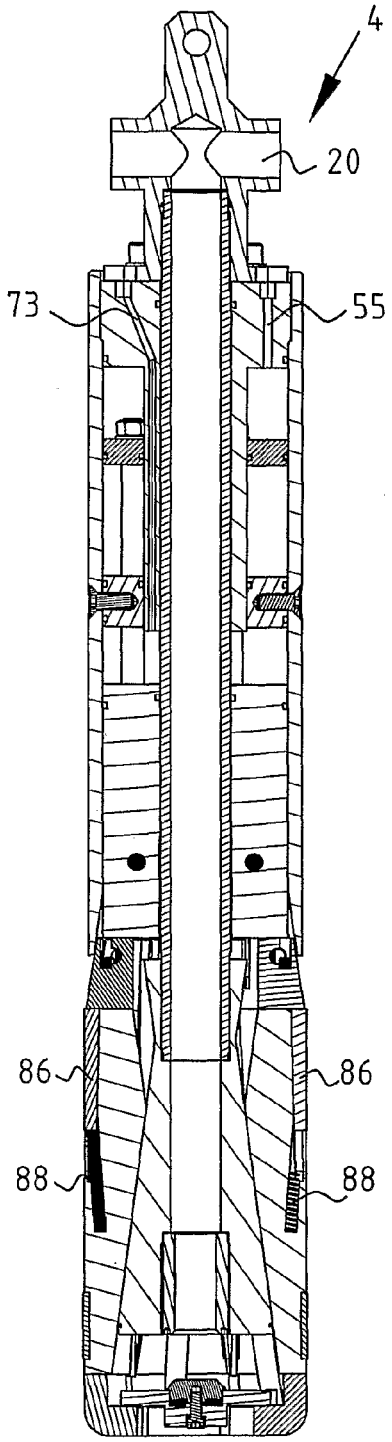
FIG. 3B a cross-section of the device from FIG. 3A over the tooth blocks.
Figure 3C:
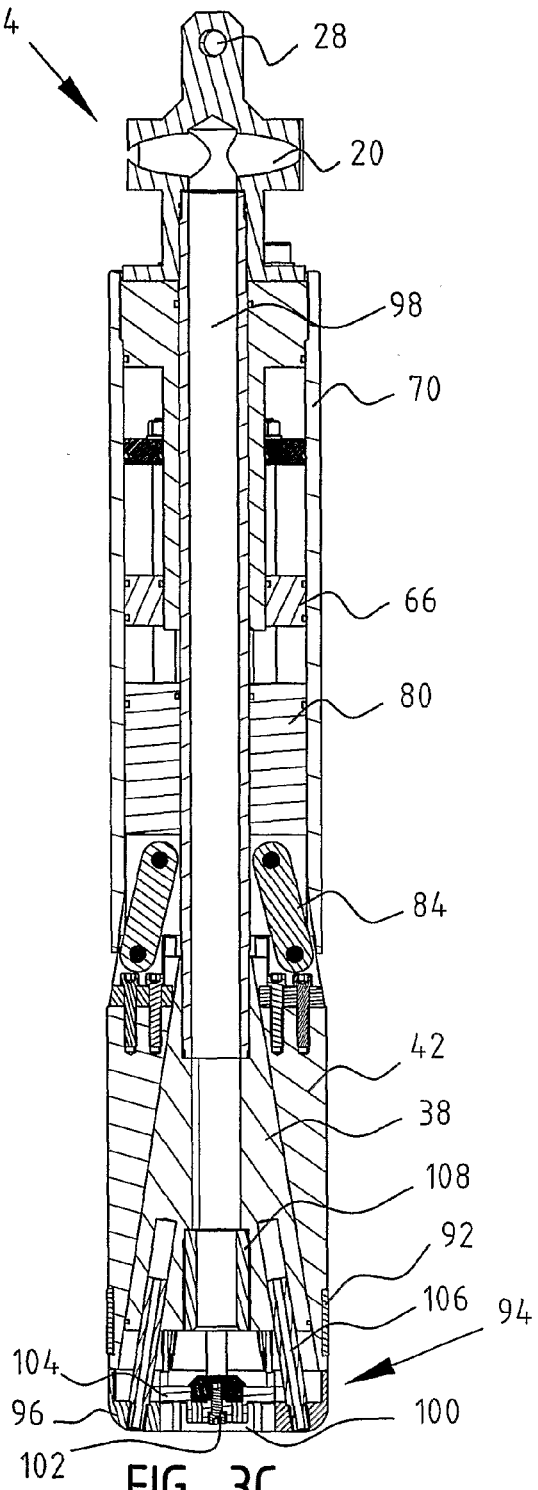
FIG. 3C another cross-section of the device from FIG. 3A over the segment linkages.
Figure 3D:
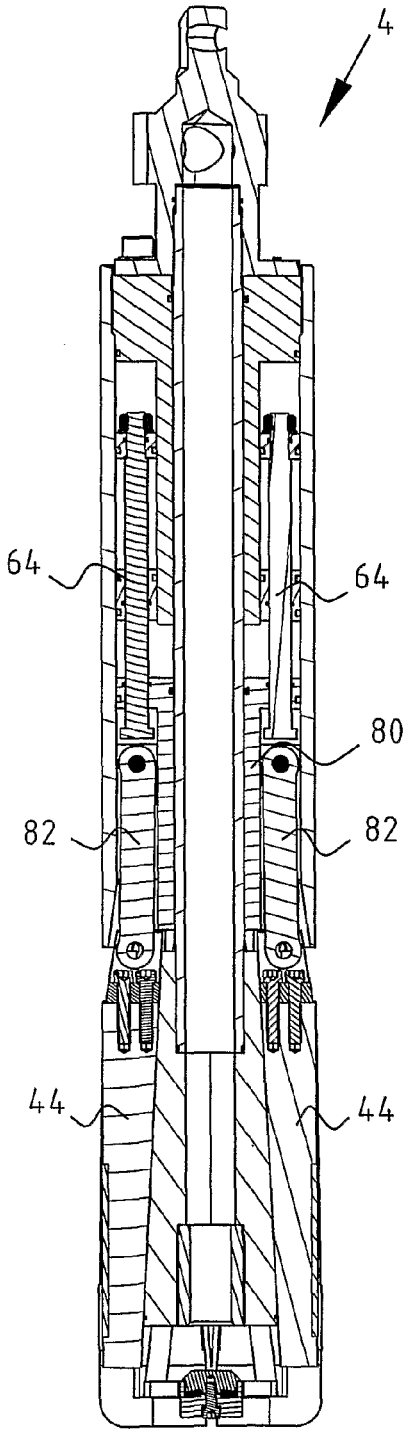
FIG. 3D a further cross-section of the device from FIG. 3A over the wedge linkages.
Figure 4D:
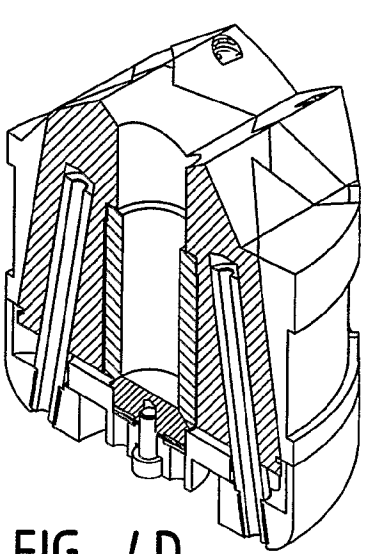
FIGS. 4A, B, C and D the supply channel together with the valve.
Figure 4C:
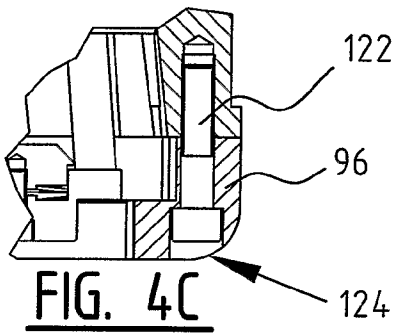
Figure 4A:
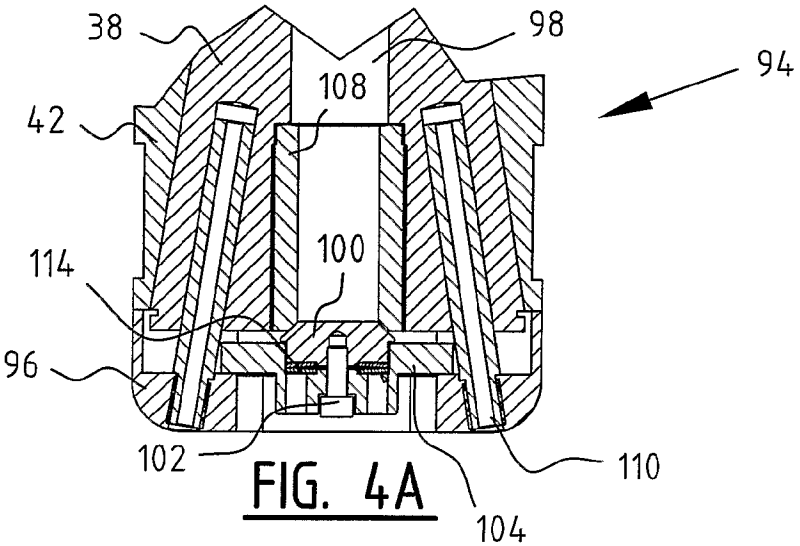
Figure 4B:
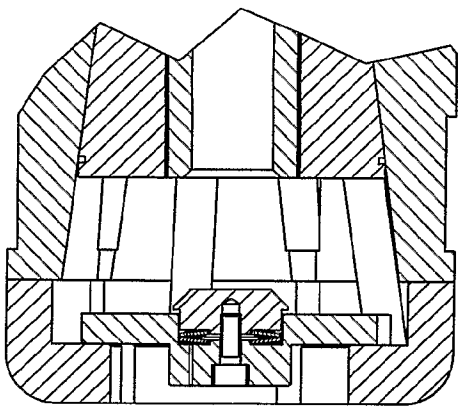

The sealing mechanism 36 (FIG. 2) comprises a core 38 provided with a supply channel 40 for the supply of mud. Core 38 also comprises a notch or groove 39 for a sealing ring. Sealing mechanism 36 further comprises sealing segments 42 and wedges 44. A wedge 44 may slide over sliding surfaces 46 of core 38. Sealing segment 42 may slide over sliding surface 48 of core 38. Wedge 44 moves relative to the sealing segment 42 over side surface 50 of sealing segment 42. The sealing mechanism 36 may be located into casing 14 to seal this casing. The sliding surfaces 48 are put at an angle with the longitudinal direction of the sealing device 4 and, therefore, transfer the segments 42 radially when sliding over core 38. As illustrated in FIG. 2, in the sealing configuration, the wedges 44 and the sealing segments 42 are alternately positioned between one another to define an outer circumference of the sealing device 4.

The sealing device or fill-up tool 4 (FIGS. 3A-3D) comprises a connecting part 28 that is connected to hoist device 26. The sealing device 4 also comprises connection 20 for supply of liquid or mud. Top lid 52 comprises connections 54 for oil supply. This oil may be brought into chamber 56 that is used to slide wedges 44 relative to sliding segments 42 and core 38. Chamber 56 is sealed with seals 58 and 60. To remove wedges 44 and sealing segments 42 from the sidewall to the casting, thereby removing the sealing of casing 14, chamber 62 is filled. Oil chamber 62 is sealed with seals 60 and 68. The wedges 44 are moved by wedge axes 64. The bottom side of chamber 62 is formed by the stationary part 66. The stationary part 66 is connected to the housing 70 through bolts or screws 72. Below the fixed part 66 lies chamber 74 for movement of the sliding segments 42 together with wedges 44. Chamber 74 is sealed with seals 76 and 78. By filling room 74 with oil, piston 80 will move downward and slide the sealing segments 42 and wedges 44 over core 38, thereby moving segments 42 and wedges 44 radially towards the casing 14. Piston 80 is connected to wedges 44 by linkages 82, and to sealing segment 42 by linkages 84. The sealing device 4 further comprises a tooth rack 86 and a spring 88. In the illustrated embodiment each segment 42 comprises two tooth racks 86 and, correspondingly, two springs. Wedge 44 comprises a sealing strip or friction part 90. The sealing segments 42 comprise sealing strip 92. The sealing strips 90 and 92 are preferably both from poly-urethane. The strip 90 on wedge 44 extends in a longitudinal direction as the wedge 44 may move relative to sealing segment 42, while at the same time the sealing perimeter must be guaranteed. The downward end or mud saver assembly 94 of the sealing device 4 comprises valve parts 96. The sealing device 4 with core 38 is provided with a supply channel 98. The supply channel 98 on end 94 is provided with a stop 100 that is connected to the cross-shaped part 104 with bold 102. Part 104 is shaped like a cross due to the fact that the illustrated embodiment involves four sealing segments 42. Valve parts 96 are connected to the sealing segments 42 by guide pen 106. The end of the supply channel 98 comprises a bush 108. Bush 108 accumulates most of the damages and wear of the sliding device 4.

To seal casing 14 oil is supplied to room 74 by channels or pipes 73, thereby moving segments 42 and wedges 44 downward. When the segments 42 engage the sidewall of casing 14, room 56 is supplied with oil by channels or pipes 55 to move the wedges 44 further downward. To remove the sealing, room 62 is supplied with oil or pipes (not shown). First, the wedges 44 will retract and chamber 56 gets smaller. After wedges 44 have joined segments 42 again, continuing the oil supply to room 62 will retract both the segments 42 and wedges 44. Chamber 56 and 74 will get smaller again and the sealing device 4 may be removed from casing 14.

The mud saver assembly 94 (FIG. 4) is positioned at the end of core 38 and supply channel 98. The assembly 94 comprises valve parts 96. In the illustrated embodiment there are four valve parts 96. The sealing segments 42 are provided with recesses for sealing strips 92. The assembly 94 further comprises the cross-shaped part 104 that is connected with stop 100 by bolt 102. The stop 100 has sides that are preferably under an angel with the direction of the sealing device 4, thereby guiding the stop 100 into the supply channel 98. Between stop 100 and part 104 there is provided at least one cup spring 114 as a safety measure to prevent undesired over-pressures inside sealing device 4. Valve parts 96 are connected to core 38 by guiding pens 106 through an opening in valve part 96 and core 38. Guiding pen 106 is on one end provided with thread 128 for connection to valve parts 96. The other end of guide pen 106 is put into the core 38. Valve part 96 is connected with sealing segment 42 by bolt 122 through opening 124 in valve part 96. Bushing 108 acts as an insert to the supply channel 96 of the sealing device 4. The outside surface of threaded bushing 108 enables an easy removal or change of insert 108 in the supply channel 96 of the sealing device 4. As wear and/or damage is accumulated in the bushing 108 maintenance and damage costs are limited.

Figure 5A:
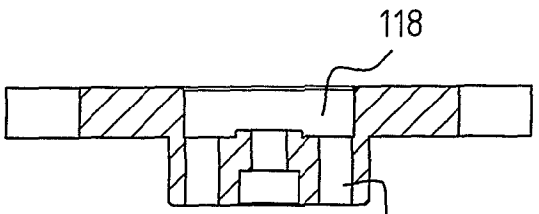
FIGS. 5A and B cross-shaped part of the valve from FIG. 4.
Figure 5B:
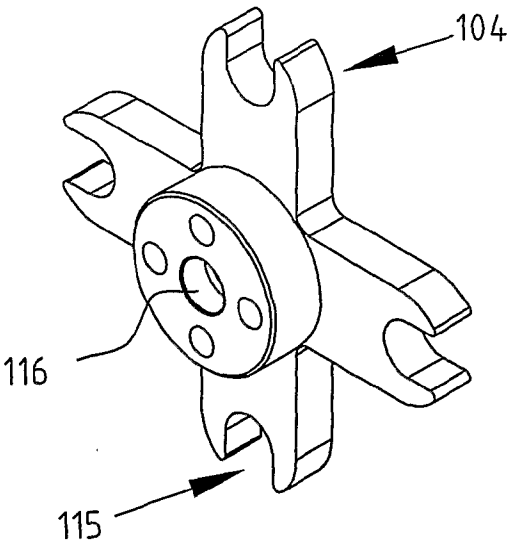

The cross-shaped valve part 104 (FIGS. 5A and B) comprises a slotted hole 115 for guiding pen 106, a central bore 116 for bold 102 connecting to the stop 100, a recess 118 for stop 100 and bore 120 to spring 114.

Figure 6A:
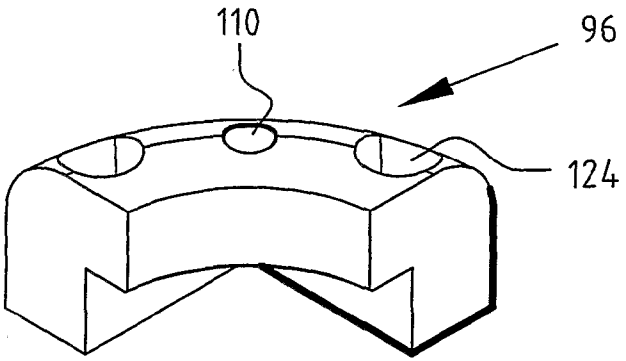
FIGS. 6A and B the valve part from FIG. 4.
Figure 6B:
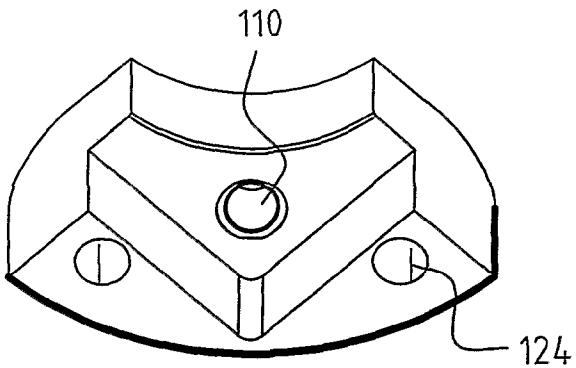

Each valve part 96 (FIGS. 6A and B) comprises an opening 110 for guiding pen 106, and bores 124 for connecting the valve part 96 with a sealing segments 42.

It is thus the case that after examination of the foregoing many alternative and additional embodiments can occur to the skilled person which all lie within the scope of the invention defined in the appended claims, unless there is a departure therein from the actual definitions or the spirit of the invention. As an example, although sealing device 4 is illustrated for a conventional drilling rig 2, also other applications in sealing of e.g. casings, hoses, conduits etc. may be realised. Also, changing the number of segments 42 and wedges 44, depending on e.g. the diameter of the casing 14, will be possible. Although the actuating means are illustrated as a hydraulic system, it may be possible to move the sealing segments 42 and wedges 44 relative to the core 38 and each other with e.g. an electronic device. It will also be possible to change the translational movement of the wedges 44 and sealing segments 42 relative to core 38, into a rotational movement, using e.g. a threaded piece for combining this rotational movement with an axial movement, thereby pushing the segments radially outward. Especially for larger diameters it would be possible to provide supply channels in the sealing segments 42, in stead of, or in combination with, the supply channel 96 in core 38.

The invention claimed is:

1. A sealing device for sealing a casing comprising:
- a housing with an outside diameter;
- a core inside the housing;
- at least two sealing segments slidable against the core to change the outside diameter of the sealing device on at least one position of the sealing device;
- at least two wedges slidable against the core and slidable against the sealing segments;
- a first actuator for moving the at least two sealing segments and the at least two wedges relative to the core; and
- a second actuator or moving the at least two wedges relative to the core and the sealing segments;
- wherein in a sealing configuration, the at least two wedges and the at least two sealing segments are positioned by the actuators against the casing and together seal the sealing device against the casing;
- wherein in the sealing configuration, the wedge and sealing segments are alternately positioned between one another to define an outer circumference of the sealing device; and
- wherein in a removed sealing configuration, the at least two wedges and the at least two sealing segments are retracted by the actuators from the casing and the outside diameter of the sealing device is decreased.

2. The sealing device according to claim 1, wherein the sealing segments, the wedges and the core each comprise a sealing strip.

3. The sealing device according to claim 1, wherein the core comprises a supply channel.

4. The sealing device according to claim 3, wherein the sealing device comprises a valve for closing the supply channel.

5. The sealing device according to claim 4, wherein the valve comprises valve parts to guide the sealing device in the casing.

6. The sealing device according to claim 4, wherein the valve comprises spring means.

7. The sealing device according to claim 3, wherein the supply channel is provided with an insert.

8. The sealing device according to claim 1, wherein the sealing device comprises a friction element to hold the sealing device relative to the casing.

9. A method for sealing a casing, comprising the steps of:
- entering a sealing device into the casing, the sealing device comprising:
  - a housing with an outside diameter;
  - a core inside the housing;
  - at least two sealing segments in slidable engagement with the core to change the diameter of the sealing device; and
  - at least two wedges in slidable engagement with the core and in slidable engagement with the sealing segments;
- slidably moving the sealing segments against the core to increase the outside diameter of the sealing device;

slidably moving the wedges against the sealing segments and against the core to seal the sealing device against the casing to define a sealing configuration;

wherein in the sealing configuration, the wedge and sealing segments are alternately positioned between one another to define an outer circumference of the sealing device;

retracting the sealing segments and the wedges to provide a gap to space the sealing device from the casing by decreasing the outside diameter of the sealing device; and withdrawing the sealing device from the casing.

10. The method according to claim 9, further comprising the step of supplying a fluid to the casing through a supply channel in the core of the sealing device, with the sealing segments and wedges in sealing or non-sealing engagement with the casing.

* * * * *

UNITED STATES PATENT AND TRADEMARK OFFICE

CERTIFICATE OF CORRECTION

PATENT NO. : 8,857,525 B2
APPLICATION NO. : 12/598850
DATED : October 14, 2014
INVENTOR(S) : Jan Noord It is certified that error appears in the above-identified patent and that said Letters Patent is hereby corrected as shown below:

IN THE CLAIMS:

Column 6, Line 23, Claim 1, delete "or" and insert -- for --

Signed and Sealed this
Tenth Day of February, 2015

Michelle K. Lee

Michelle K. Lee
*Deputy Director of the United States Patent and Trademark Office*